United States Patent [19]

Bullock

[11] 3,977,332

[45] Aug. 31, 1976

[54] VARIABLY DAMPED TRUCK

[75] Inventor: Robert L. Bullock, Lombard, Ill.

[73] Assignee: Standard Car Truck Company, Chicago, Ill.

[22] Filed: June 25, 1975

[21] Appl. No.: 590,294

[52] U.S. Cl. ..... 105/197 DB; 105/197 D; 267/4

[51] Int. Cl.[2] ..... B61F 5/12; B61F 5/50; F16F 1/06; F16F 3/04

[58] Field of Search ..... 105/197 D, 197 DB; 267/4

[56] References Cited

UNITED STATES PATENTS

| | | | |
|---|---|---|---|
| 2,403,352 | 7/1946 | Edstrom | 105/197 D |
| 2,413,458 | 12/1946 | Light | 105/197 DB |
| 2,675,765 | 4/1965 | Hamilton | 105/197 DB |
| 2,873,691 | 2/1959 | Guins | 105/197 DB |
| 3,756,162 | 9/1973 | Wulff | 267/4 X |
| 3,762,694 | 10/1973 | MacDonnell | 267/3 |
| 3,845,725 | 11/1974 | Gieriach | 105/197 DB |
| 3,851,595 | 12/1974 | Clasen | 105/197 D X |

*Primary Examiner*—Robert J. Spar
*Assistant Examiner*—Howard Beltran
*Attorney, Agent, or Firm*—Kinzer, Plyer, Dorn & McEachran

[57] ABSTRACT

A stabilized railroad car truck has a side frame with a window, a bolster extending into the window, a stabilizer pocket on each side of the bolster and a friction element in each pocket. The spring means constitute coaxially positioned spring assemblies supporting each friction element provide generally constant column pressure from each friction element onto its associated side frame wearing area from no load up until approximately half-load, with linearly increasing column pressure from approximately half-load up until full load.

3 Claims, 3 Drawing Figures

VARIABLY DAMPED TRUCK

SUMMARY OF THE INVENTION

The present invention relates to stabilized car trucks and in particular to an improved spring support for the stabilizing wedges.

A primary purpose of the invention is a stabilized car truck in which one spring element supports or activates the stabilizing wedge over a portion of its load curve and a second spring element supports the stabilizing wedge over the remaining portion of the load curve.

Another purpose is a stabilized railroad car truck utilizing a plurality of springs to support the stabilizing wedges, with the wedge load being transferred from one spring to the other when the load on the springs is approximately equal.

Another purpose is a stabilized car truck including an upper damping spring supported on the bolster and a lower damping spring supported on the side frame.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

As is well known in the art, lightly loaded railroad freight cars have a tendency to oscillate as the wheels follow a certain wave length "on tangent" rail and this action will cause vibration in the car. When vibration from the rail/wheel action approximates the amplitude and frequency of the natural vibrating frequencies of the load springs supporting the car, together with the sum of the car's mass components, harmonics develop which, in the absence of damping resistance, can build up to an objectionable amplitude. This is a phenomenon known in the art as "hunting." Hunting is a severe problem in lightly loaded cars. On the other hand, loaded cars have a tendency to bounce and rock as they pass over alternating rail joints, which movements again can be objectionable if not sufficiently damped. This is a phenomenon known in the art as "rock and roll."

Stabilized car trucks have been common in the art for a number of years. However, it has been difficult to provide a damping system which can compensate both for hunting of lightly loaded cars and for the bouncing and rocking motion of heavily loaded cars. The present invention provides a damping system with generally constant damping pressure from no load until approximately one half load and thereafter linearly increasing damping pressure up until full load.

Figure 1:
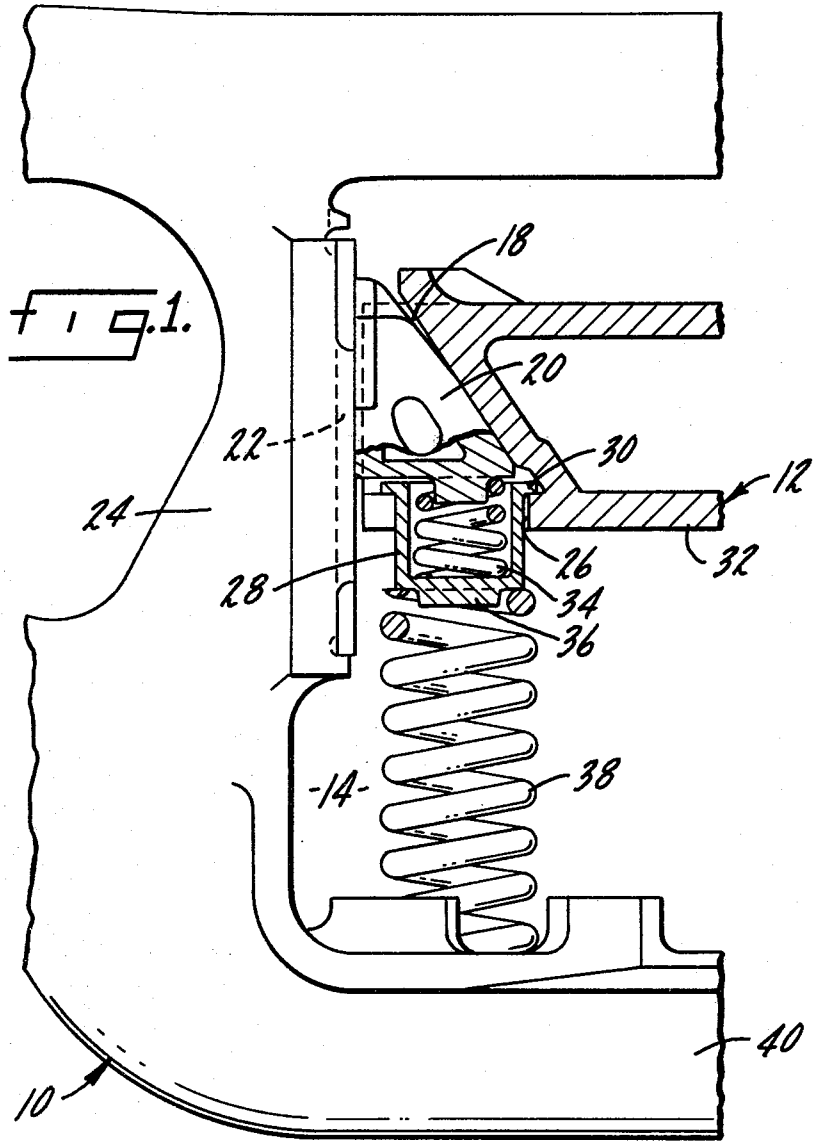
FIG. 1 is a partial side view of a stabilized car truck formed in accordance with the present invention.

In FIG. 1 a railroad car truck side frame is indicated generally at 10 and a bolster 12 is shown positioned within a window 14 of the side frame. Load springs not shown will customarily support the bolster within the window.

At each side of the bolster there are stabilizing pockets 18 within which is positioned a friction element or friction wedge 20. The wedge 20 will bear against a vertical wear plate 22 supported on vertical column 24 which connects the tension and compression members of the side frame as is common in the art. Although not shown herein, the stabilizer pocket 18 may also include a slanted wear plate which receives pressure from the slanted surface of wedge 20.

In alignment with bolster stabilizer pocket 18 is an opening 26 in lower bolster member 32. A spring retaining cup 28 is positioned in opening 26 and has outwardly-directed flanges 30 which are seated upon the upper surface of bolster member 32. Positioned within cup 28 is a spring 34 which will be under compression when assembled and which bears against the bottom surface of wedge 20.

The lower end of cup 28 has a projection 36 which aligns the upper coil of a lower spring 38 with cup 28. Spring 38 is bottomed on side frame compression member 40.

Figure 3:
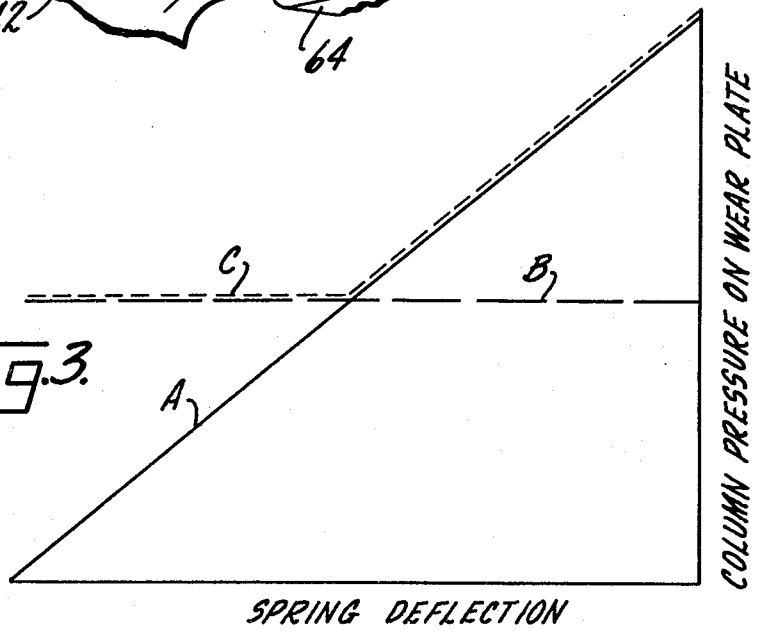
FIG. 3 is a curve illustrated spring deflection vs. column pressure on the side frames of a stabilized railroad car truck.

Looking particularly at FIG. 3, which is a curve of spring deflection vs. pressure exerted on the side frame column wear plate, curve A defines the damping pressure provided for a stabilized car truck of the type shown in U.S. Pat. No. 2,873,691. The damping force linearly increases from no load up until full load. Curve B represents another type of stabilizing arrangement in which there is constant column pressure exerted by the stabilizing wedges on the column wear plates from no load up until full load on the car. Neither type of stabilizer has been totally satisfactory in solving the mutually inconsistent problems of hunting under lightly loaded conditions and bouncing and rocking at heavier loaded conditions.

Figure 2:
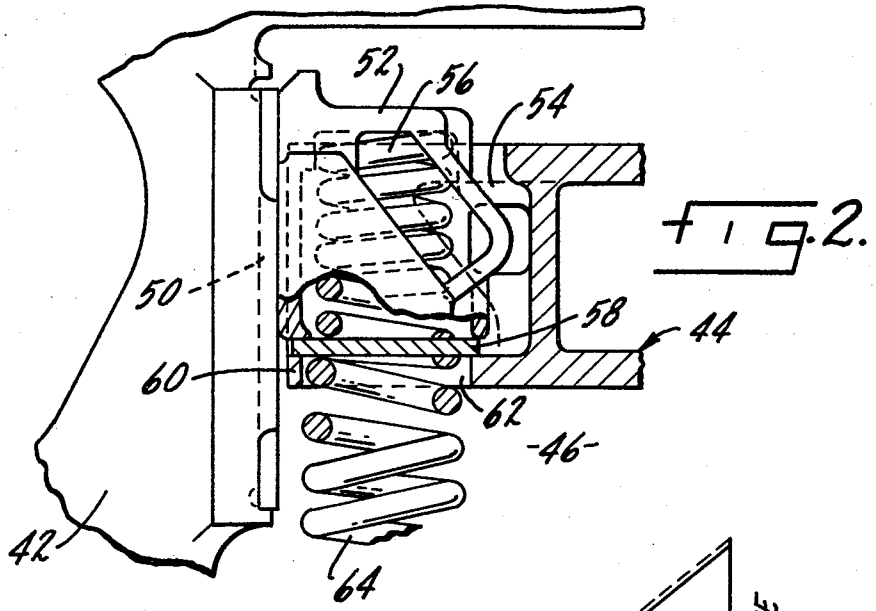
FIG. 2 is a partial side view, similar to FIG. 1, but showing a modified form of the invention.

Curve C represents the damping characteristics of the structures of FIGS. 1 and 2. From no load up until approximately one half load on the car, there is generally constant damping pressure. From this point up until full load there is linearly increasing damping pressure. Thus, sufficient damping pressure is provided to overcome hunting at lightly loaded conditions and gradually increasing damping pressure is thereafter provided to compensate for oscillations occuring during heavier loaded conditions.

As indicated above, spring 34 is compressed before or during installation. Under lightly loaded conditions substantially the entire damping force is provided by spring 34. Spring retainer cup 28 rests on the bolster and supports spring 34 which provides an upward force upon the wedge which will thus cause the wedge to exert a force on the vertical wear plate. The force is constant as long as the load is not of sufficient magnitude to cause flanges 30 to lift off the bolster and contact wedge 20 or cause spring 34 to become solid. Note the small gap between the bottom of wedge 20 and the top of flange 30.

When the load on the car is such that the force provided by spring 34 is equal to the force provided by spring 38, spring retainer 28 will be lifted off the bolster and lower spring 38 will thereafter provide substantially the entire damping force. Spring 34 will be compressed and flange 30 will be in contact with the bottom of wedge 20 or spring 34 will be solid. Since spring 38 has not been precompressed it will provide a damping force which increases linearly with load on the car. Spring 34, on the other hand, as it was precompressed, provided a generally constant damping force, regardless of load. However, when the damping forces provided by the springs are approximately equal, the load is transferred from spring 34 to spring 38. Thus, during a lightly loaded condition spring 34 provides a damping force which is generally constant. Under heavier load conditions spring 38 provides a linearly increasing damping force. The springs are neither in series nor in parallel. Rather, the load is transferred from one spring to the other generally at approximately one half of the car load, but more particularly when the loads carried by the springs are generally equal.

Referring to FIG. 3, the same damping principle is applied to a somewhat different stabilizing structure. A side frame 42 supports a bolster 44 within a window 46. The customary load springs will support the bolster. A vertical column wear plate is indicated at 50 and it will receive damping force from a friction wedge 52 which is positioned within the bolster pocket 54. Friction wedge 52 is hollow, thus permitting upper spring 56 to be positioned within it. Spring 56 is seated upon a plate 58 which functions in the same manner as spring retainer cup 28 to support the upper spring and to be in force transmitting relation between the bolster and the friction wedge. Thus, under lightly loaded conditions spring 56 provides a damping force and will be seated upon plate 58 which in turn is seated upon the bolster.

The lower wall 60 of bolster 44 has an opening 62 through which passes the upper portion of lower spring 64. Spring 64 is seated upon the compression member of the side frame at its lower end and is in position to contact plate 58 at its upper end.

The operation of the structure in FIG. 2 is the same as that in FIG. 1. Under lightly loaded conditions, the precompressed spring positioned within the hollow friction element or casting will provide the damping force on column wear plate 50. At such time as the load carried by lower spring 64 is generally equal to that carried by spring 56, plate 58 will be lifted off of the bolster and thereafter substantially all of the load will be carried by the lower spring. Thus, there will be a linearly increasing damping force from approximately half load up until full load.

The invention should not be limited to any particular construction for either the upper spring or the lower spring or the means for supporting them. What is important is to provide a lower spring which is supported on the side frame and an upper spring which is supported, under certain loading conditions, by a spring retainer member which is in turn supported by the bolster. The upper or precompressed spring may be positioned beneath the friction wedge or it may be positioned within it.

Although springs 34 and 38 have been each shown as a single element, it should be understood that either or both could be replaced by a plurality of springs without any change in function.

Whereas the preferred form of the invention has been shown and described herein, it should be realized that there may be many modifications, substitutions and alterations thereto.

The embodiments of the invention in which an exclusive property or privilege is claimed are defined as follows:

1. A stabilized railroad car truck including a side frame having a window, a bolster extending into the window, a stabilizer pocket on each side of the bolster and a friction element in each pocket, the improvement comprising spring means supporting each friction element including an upper spring and a lower spring, an opening in said bolster in alignment with each stabilizer pocket, a cup-shaped spring support member supported on said bolster under light load conditions and extending through said bolster opening, an outwardly directed flange on the upper end of said cup-shaped spring support member, with said flange being supported by said bolster about the opening thereof, said upper spring being precompressed within said spring support member and between said spring support member and said friction element, said lower spring being supported on said side frame and having an upper coil thereof in contact with the bottom surface of said cup-shaped spring support member.

2. The structure of claim 1 further characterized in that said spring support member is positioned to directly transfer force from said lower spring to said friction element under certain load conditions.

3. The structure of claim 1 further characterized in that said friction element is supported substantially on its upper spring, from a no load condition up until approximately a half-load condition, with said friction element being supported substantially on its lower spring at greater loads.

* * * * *